United States Patent [19]

Shida et al.

[11] 3,975,076

[45] Aug. 17, 1976

[54] RECEPTACLE FOR PRINTED CIRCUIT BOARD

[75] Inventors: Sankichi Shida, Nara; Koji Hashimoto; Hyogo Hirohata, both of Neyagawa; Katsuhiko Honjo, Katamo, all of Japan

[73] Assignee: Matsushita Electric Industrial Co., Ltd., Osaka, Japan

[22] Filed: Oct. 4, 1973

[21] Appl. No.: 403,445

[30] Foreign Application Priority Data

Dec. 6, 1972 Japan ..... 47-122763

[52] U.S. Cl. ..... 339/17 L; 339/125 R; 339/184 M; 339/278 C

[51] Int. Cl.[2] ..... H05K 1/07; H01R 13/64

[58] Field of Search ..... 339/17 L, 17 LM, 125, 339/126, 128, 176 MP, 176 MF, 184 M, 186 M, 278 C, 75 MP; 29/199; 200/269

[56] References Cited

UNITED STATES PATENTS

| | | | |
|---|---|---|---|
| 2,476,886 | 7/1949 | Miller et al. | 339/278 C X |
| 2,853,689 | 9/1958 | Jackson et al. | 339/176 MP |
| 2,875,425 | 2/1959 | Gilbert | 339/176 MP |
| 2,882,511 | 4/1959 | Mason | 339/176 MP |
| 2,911,609 | 11/1959 | Burtt et al. | 339/17 LM |
| 2,980,880 | 4/1961 | Winkler et al. | 339/128 X |
| 3,015,797 | 1/1962 | Mitchell et al. | 339/184 M |
| 3,046,516 | 7/1962 | Tymkewicz | 339/126 R |
| 3,172,719 | 3/1965 | Paholek et al. | 339/176 MP X |
| 3,330,631 | 7/1967 | Tsu | 29/199 |
| 3,367,755 | 2/1968 | Packer et al. | 29/199 |
| 3,392,366 | 7/1968 | Nakazawa | 339/176 MP |
| 3,402,384 | 9/1968 | Murakami et al. | 339/128 |
| 3,478,303 | 11/1969 | Dauser | 339/278 C X |
| 3,530,422 | 9/1970 | Goodman | 339/176 MP X |
| 3,566,340 | 2/1971 | Jayne et al. | 339/186 M |
| 3,573,008 | 3/1971 | Akin | 29/199 |
| 3,682,604 | 8/1972 | Girard et al. | 29/199 |
| 3,718,750 | 2/1973 | Sayers | 339/278 C |
| 3,740,699 | 6/1973 | Johnson et al. | 339/176 MP |
| 3,762,883 | 10/1973 | Shepard et al. | 29/199 |

FOREIGN PATENTS OR APPLICATIONS

| | | | |
|---|---|---|---|
| 663,398 | 5/1963 | Canada | 339/176 MP |
| 1,503,523 | 10/1967 | France | 339/184 M |
| 994,421 | 6/1965 | United Kingdom | 339/176 MP |
| 820,362 | 9/1959 | United Kingdom | 339/17 LM |

OTHER PUBLICATIONS

*Metals Handbook*, p. 962, 1961.

Tanii et al., "Connectors for NTT's Electronic Switching System", vol. 19, Nos. 9–10, Sept. 1971.

Burndy Data Sheet HSSB, *Electronic Design*, Aug. 16, 1963.

*Primary Examiner*—Roy D. Frazier
*Assistant Examiner*—Lawrence J. Staab
*Attorney, Agent, or Firm*—Wenderoth, Lind & Ponack

[57] ABSTRACT

A connector which has bellows type contacts of spring metal and a holder which has a bottom, a longitudinal slot for receiving a circuit panel, a cavity for housing the bellows type contact, a hollow formed at upper portion of the cavity and partition wall for separating the adjacent contacts. The bellows type contact consists of a lower end portion, an attached portion, a first bent portion, a second bent portion, a straight portion, a third bent portion and an upper end portion. The straight portion is the portion contacting the panel circuit. The contact has a spring substrate which consists of phosphor bronze, a contact metal of tin or tin-lead alloy, and a layer of copper between the substrate and the contact metal. With the improved shape and material of the contact, there is provided better contact performance even for a contact of tin or tin-lead alloy which is very cheap compared to the conventional gold contact and it is thus advantageous for use in consumer type electric equipment.

12 Claims, 19 Drawing Figures

RECEPTACLE FOR PRINTED CIRCUIT BOARD

BACKGROUND OF THE INVENTION

This invention relates to an electric connector and an improved contact therefor, and more particularly to an improved and novel connector having better characteristics, which has a low cost and which can be attached to a printed circuit board firmly without erroneous insertion.

Recently, connectors have been widely used in various electronic devices. For example, in order to simplify assembly of an electronic device such as a TV receiver and to simplify replacement of imperfect parts, the circuits of the device are divided into several blocks, and the blocks and the board are mutually connected by the connectors.

For the contact metal of these connectors, conventionally noble metal such as gold or rhodium is plated on the surface of the contact of the connector, and for the spring material of the connector there is used a precipitation hardened metal such as beryllium copper and titanium copper. however, although a contact made of these materials has good contact characteristics, there are disadvantages such as that it is usually expensive and that the productivity is poor due to the necessity for thermal treatment of the spring material.

As the cost is an important factor especially in consumer type electronic devices, sometimes there is used a base metal such as tin or tin-lead alloy for the contact metal, and phosphor bronze annealed at a low temperature for the spring material. However, there is also a disadvantage in a contact consisting of such a low cost material. That is, at a high temperature, phosphorus contained in phosphor bronze reacts with tin, and a very brittle chemical compound is formed between the tin and phosphor bronze. This causes exfoliation of the tin layer from the spring of phosphor bronze, and so there is caused failure of the contact.

Moreover, as the base metal has an electric conductivity lower than the noble metal and a melting point lower than gold, the current capacity of the contact of the base metal is lower than that of the contact of the noble metal. Further, when vibration is caused at the contact, insulating black powder is often produced by the contact of the base metal, and so the contact resistance is greatly increased. Therefore, when a connector using a contact of tin or tin alloy is used for an electronic acoustic device including a vibration source such as a speaker or for an electronic device employed in a mobile apparatus, there is a tendency toward contact failure. On the other hand, usually a circuit panel is inserted tightly into the connector using such a contact, which is mounted on a printed circuit board, so as to increase the contact force and thereby to compensate for poorer contact performance. However, in this case, there is another problem of deformation and sometimes cracking of the printed circuit board at the time of inserting the circuit panel into the connector or removing the circuit panel therefrom.

SUMMARY OF THE INVENTION

Therefore, an object of the present invention is to provide an improved contact of tin or tin alloy having better contact performance than heretofore.

Another object of the invention is to provide a novel and improved connector having a contact capable of enduring external shock such as vibration yet which has high electric current capacity.

Still another object of the invention is to provide a connector which comprises a contact of tin or tin alloy and has better contact characteristics such as electric current capacity, long life and resistance against high temperature and vibration than prior art contacts.

Yet another object of the invention is to provide a connector which does not cause deformation or cracking of the printed circuit board on which the connector is mounted, even when a circuit panel is tightly inserted into the connector or removed therefrom.

A further object of the invention is to provide a connector which can be applied to many circuits by a simple treatment at assembling, resulting in great improvement of productivity of the connector and thus a reduction in cost.

These objects are achieved by providing an electric contact comprising a spring substrate consisting of phosphor bronze, a contact metal consisting of tin or tin alloy, and a layer of copper formed between said substrate and said contact metal having a thickness of at least 2 microns; and by providing a connector comprising such contacts shaped into a bellows type contact and a holder having a bottom, a longitudinal slot for receiving a circuit panel, cavities for housing said bellows type contacts, hollows formed at the upper portions of said cavities and partition walls for separating the adjacent bellows type contacts, each said bellows type contact consisting of a lower end portion to be inserted to a hole of a printed circuit board, an attached portion extending from said lower end portion and along horizontal and vertical inside walls of said cavity of said holder so as to attach said bellows type contact to said holder, a first bent portion at an upper portion within said cavity so as to be elastic and extending from said attached portion, a second bent portion at a lower portion of said cavity extending from said first bent portion, so as to be elastic and not so as to touch said attached portion, a straight portion extending from said second bent portion, said straight portion operating as a contact portion for contacting said circuit panel to be inserted into said slot of the edge connector, a third bent portion extending from said straight portion over said first bent portion so as to be elastic, and an upper end portion which is held in said hollow, the upper end of said straight portion being held by said third bent portion, and the lower end of said straight portion being held by said first and said second bent portions.

BRIEF DESCRIPTION OF THE DRAWINGS

These and other objects and features and advantages of the present invention will be apparent from the following description taken in connection with the accompanying drawings wherein.

DETAILED DESCRIPTION OF THE INVENTION

There will first be described the contact according to the present invention, which is to be used for a connector.

Figure 1:
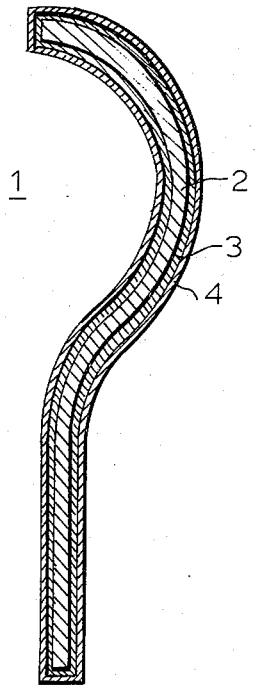
FIG. 1 is a sectional view of a contact according to the invention used for a connector.

Referring to FIG. 1, a contact 1 according to the invention comprises a phosphor bronze spring metal base 2 which is formed in a desired shape, a copper layer 3 formed on the phosphor bronze 2 and a layer 4 of tin or tin alloy plated on the copper layer 3 for the contact metal. The copper layer is given a thickness greater than 2$\mu$.

In plating a metal on the substrate, a layer of copper is usually formed on the substrate to a thickness of less than 1$\mu$ for strike plating in order to secure the layer of the plated metal. The inventors have found by many experiments that for contact of tin or tin alloy on phosphor bronze, the characteristics of the contact can be improved so as to satisfy more severe conditions for practical use by plating a layer of copper to a thickness of greater than 2$\mu$ between the phosphor bronze base and the layer of tin or tin alloy. For example, even if such a contact is kept at a temperature of 105°C for 500 hours or at 85°C for 2000 hours there is no reaction of phosphorus and tin, and so tin is never exfoliated from the substrate.

As the composition of the bath for the copper plating, cuprous cyanide, or cuprous or cupric sulfate compositions are desirable. Although there are various kinds of copper plating bath compositions, a composition containing a small amount of phosphorus such as a cupric pyrophosphate bath composition is undersirable because phosphorus in the bath composition reacts with tin.

EXAMPLE 1

A phosphor bronze base for a spring was formed into a desired shape, and degreased and electrolytically cleaned. After that, a layer of copper having a thickness of 2$\mu$, and then a layer of tin having a thickness of 6$\mu$ were plated thereon from the following aqueous cuprous cyanide and stannous sulfate bath compositions, respectively.

| Cuprous cyanide bath composition | |
|---|---|
| cuprous cyanide | 60 g/l |
| sodium hydroxide | 20 g/l |
| sodium cyanide | 75 g/l |
| bath temperature | 60°C |
| current density | 2A/dm$^2$ |
| **Stannous sulfate bath composition** | |
| stannous sulfate | 60/g/l |
| sulfuric acid | 80 g/l |
| cresol, sulfonic acid | 2 g/l |
| $\beta$-naphthol | 1.25 g/l |
| bath temperature | 25°C |
| current density | 4A/dm$^2$ |

The resultant contact is designated as sample No. 1.

EXAMPLE 2

The cuprous cyanide bath composition of Example 1 was replaced with an aqueous copper sulfate bath composition, and a contact designated sample No. 2 was made in the same manner as in Example 1 with the following bath composition:

| Copper sulfate bath composition | |
|---|---|
| copper sulfate | 200 g/l |
| sulfuric acid | 40 g/l |
| bath temperature | 40°C |
| current density | 3 A/dm$^2$ |

For the comparing the contacts of the invention prepared as described above with the conventional one, samples Nos. 3 and 4 were made as follows:

Sample No. 3

In the bath composition of Example 2, the layer of copper was formed having a thickness of 1$\mu$.

Sample No. 4

The cuprous cyanide bath composition of Example 1 was replaced with an aqeuous cupric pyrophosphate bath composition, and

| Cupric pyrophosphate bath composition | |
|---|---|
| cupric pyrophosphate | 345 g/l |
| potassium hydroxide | 18 g/l |
| 28% ammonia | 10cc/l |
| bath temperature | 50°C |
| current density | 2A/dm$^2$ |

Four kind of contacts made as described above were mounted in a plastic holder, and connectors having 18 pins were made. Then, tin-plated terminals of a printed circuit panel were inserted into the resultant connector and the characteristics were tested. The contact resistance was measured by a voltage dropping method at a DC voltage of 20 mV and current of 1 mA while connecting 18 pins or 9 pins in series. The results are shown in the following table. As is obvious from the table, the contact of the invention has very stable performance characteristics and does not cause exfoliation of tin from the bade of phosphor bronze.

| | condition | contact | contact resistance (mΩ) before test | after test | exfoliation of tin |
|---|---|---|---|---|---|
| high | temperature: 105°C | Sample No. 1 | 8 | 13 | no foliation |
| | | Sample No. 2 | 10 | 12 | no foliation |
| temperature | time: 500 hours | Sample No. 3 | 11 | 65 | all foliation |
| test | no load | Sample No. 4 | 10 | 93 | all foliation |
| current | AC 5A apply to alternate pins | Sample No. 1 | 9 | 11 | no foliation |
| | | Sample No. 2 | 11 | 14 | no foliation |
| load | room temperature | Sample No. 3 | 13 | 125 | all foliation |
| test | time: 1,000 hours | Sample No. 4 | 10 | 56 | partial foliation |

The above described contact of the invention comprising a layer of tin or tin alloy is especially useful for various consumer-type electronic equipment because of its low cost, for example for connecting blocks of circuits of a TV receiver to a printed circuit board. However, as the electric conductivity and melting point of tin are inferior to those of gold, the current capacity thereof is low. In addition, the contact having the tin layer surface is considerably affected by vibration. Therefore, in order to provide a connector using such a contact and having better characteristics, it is necessary to improve the structure of the connector.

Figure 2:
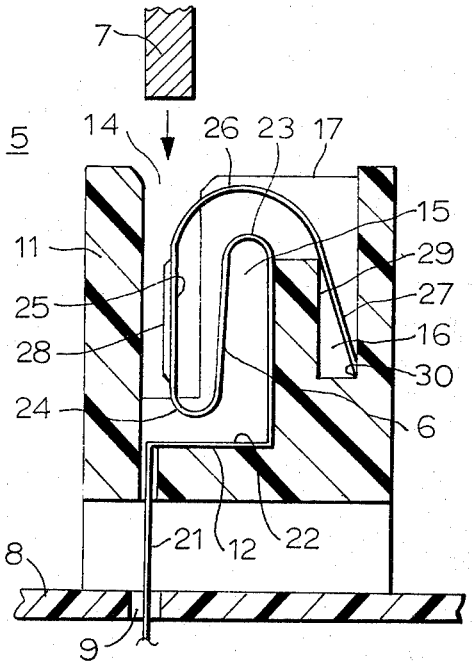
FIGS. 2 and 3 are sectional views of a connector of the invention showing the shape of the bellows contact thereof, in the states where a circuit panel is out of the connector and is inserted therein, respectively.

FIG. 2 shows an embodiment of the invention. Referring to FIG. 2, a connector 5 according to the invention has a contact spring 6 which has two fulcrums and the portion for contacting a flat terminal of a circuit panel 7, which is to be inserted into the connector 5, is between these two fulcrums, so that there is provided a close contact between the connector and the circuit panel with high current capacity and high resistance against vibration.

FIG. 2 is a sectional view of the connector of the invention for showing the shape of the bellows type contact of spring metal 6. The connector 5 is mounted on a printed circuit board 8 and has the lower end portion 21 of the contact 6 extending through a hole 9 in the board 8. A holder 11 for the connector 5 has a longitudinal slot 14 for receiving the circuit panel 7, a cavity 15 extending into the connector 5 from the slot 14 and having a lower portion having a bottom 12 for housing the bellows type contacts, and an upper portion extending laterally from the lower portion remote from said slot 14, and a hollow 16 depending into the connector from the upper portion of the cavity 15. Partition walls 17 are spaced along the cavity for separating the adjacent portions of the cavity for the bellows type contacts.

Figure 3:
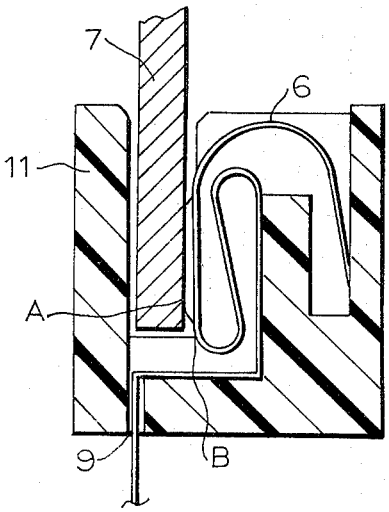

The bellows type contact 6 consists of the lower end portion 21, an attached portion 22, a first bent portion 23, a second bent portion 24, a straight portion 25, a third bent portion 26, and an upper end portion 27, all connected together. As described above, the lower end portion is inserted into the hole 9 of the printed circuit board 8. The attached portion 22 is connected to the lower end portion 21 and extends along the horizontal and vertical inside walls of the lower portion of the cavity 15 in holder 11 so as to attach the bellows type contact 6 to the holder 11. The first bent portion 23 is bent in a downwardly open U-shape through nearly 180° in the upper portion within the cavity 15 and is connected to the attached portion 22. The second bent portion 24 is also bent in an upwardly open U-shape through nearly 180 degrees at the lower portion of the cavity 15 and is connected to the lower end of the first bent portion 23 and spaced laterally of the first bent portion 23 in a direction toward the slot 14. Second bent portion 24 is above and does not touch the attached portion 22. The straight portion 25 is connected to the second bent portion 24 and extends upwardly therefrom in the vicinity of the slot 14. When the circuit panel 7 is inserted into the sot 14 of the connector 5, the straight portion 25 acts as a contact portion for contacting the circuit panel 7, as shown in FIG. 3. The third bent portion has a downwardly open U-shape and is connected to the upper end of the straight portion 25 above the first bent portion 23 in the upper portion of the cavity 15. The upper end portion 27 is connected to the third bent portion 26, and it extends downwardly into and is held in the hollow 16 of the holder 11. As the first, second and third bent portions have a U-shape, they have elasticity.

According to the improved structure of the bellows contact 6 as described above, when the circuit panel 7 is inserted into the slot 14 of the holder 11, the straight portion 25 of the contact 6 can be kept parallel and in linear contact to the inserted circuit panel 7. Further, in order to further improve the linear contact, a linear projection 28 is formed on the straight portion 25 by pressing projection 28 onto straight portion 25. Moreover, as the contact is held between two fulcrums, there is provided close contact between the straight portion 25 (or the projection 28 thereon) and the circuit panel 7. That is, the upper end of the straight portion 25 is held by one fulcrum, the third bent portion 26, and the lower end of the straight portion 25 is held by another fulcrum, the first and second bent portions 23 and 24, which are formed so as to be elastic respectively. The close contact is further improved because the first and second bent portions 23 and 24 are U-shaped and can bent through an angle of more than 180° when the circuit panel is inserted, as shown in FIG. 3. Therefore, a contact pressure for contacting to the circuit panel 7 can cause two fulcrums to bend. When the circuit panel is withdrawn, the shape of the bellows contact 6 is controlled by the upper portion 29 and the lower portion 30 of the inside wall of the hollow 16 of the holder 11, as shown in FIG. 2. When the circuit panel 7 is inserted into the slot 14, the upper end portion 27 is moved toward the portion 30 of the wall of the hollow 16 as shown in FIG. 3, and so the holding of the straight portion 25 by the third bent portion 26 is further assisted.

Figure 4A:
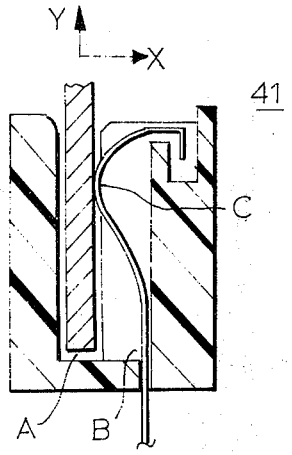
PRIOR ART FIG.4A
FIGS. 4A–4C are sectional views of some examples of a conventional connector for showing the shape of the conventional bellows contact in comparison with that of FIG. 3 of the invention.
Figure 4B:
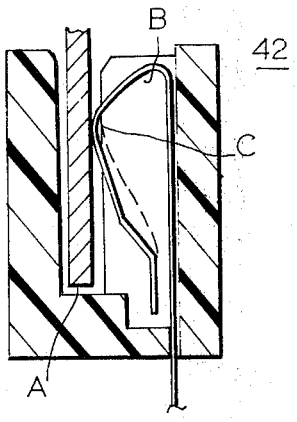
PRIOR ART FIG.4B
Figure 4C:
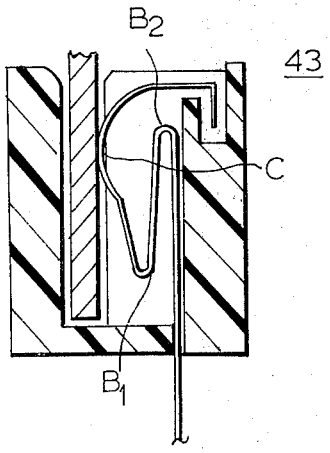
PRIOR ART FIG.4C

By the structure as described above, there is provided strong and close contact between the contact and the circuit panel. Therefore, the performance of the connector using a contact of tin or tin alloy layer can be greatly improved with respect to characteristics such as current capacity and resistance against vibration. In order to prove the improved characteristics of the connector of the invention, a vibration test was carried out in comparison with the conventional connectors as shown in FIGS. 4A–4C.

The vibration test was carried out in the horizontal (X-axis) and vertical (Y-axis directions, as shown in FIG. 4, under the following conditions.

X-axis: Vibrations of an amplitude of 5 m/m and cycle of 0.2 Hz were applied 10,000 times to the circuit panel inserted into the connector, at a portion of the circuit panel 30 m/m above the upper open surface of the connector.

Y-axis: Vibrations of 0.5 m/m and 6 Hz were applied 10,000 times to the circuit panel inserted in the connector.

The contact materials of the connector contact and the circuit panel contact: a gold layer $1\mu$ in thickness (underlayer: nickel layer $3\mu$ in thickness), a tin layer $6\mu$ in thickness, or a tin-lead alloy layer $6\mu$ in thickness (tin: 90 to 95 wt. %) was used as shown in the following table.

Contact pressure: 300 to 500g.

Number of samples: five pins for each connector. The characteristics were evaluated by the values of the average contact resistance after and before the vibration test. The results are shown in the following table. Further, on observing the contacting point after the vibration test, although there was found a little black fine powder in case of the gold contact, in case of the tin or tin-lead alloy contact, there was found a large amount of black product, and because of the one point contact, there was a dented portion in the contact of the circuit panel and black product was piled therein. On the other hand, at the contact of the connector, the surface was worn and the substrate was exposed.

| sample | contact material | | contact resistance (mΩ) | | | |
|---|---|---|---|---|---|---|
| | | | X-axis vibration | | Y-axis vibration | |
| | connector | panel circuit | before test | after test | before test | after test |
| No. 5 | Sn | Sn | 7.3 | 14.6 | 6.8 | 23.5 |
| | Sn | Sn—Pb | 8.5 | 24.3 | 7.7 | 12.5 |
| No. 6 | Au | Au | 5.5 | 6.2 | 5.6 | 5.8 |
| | Sn | Sn | 5.7 | 16.5 | 5.7 | 398 |
| No. 7 | Au | Au | 8.8 | 8.3 | 8.7 | 8.8 |
| | Sn—Pb | Sn—Pb | 9.8 | 485 | 9.3 | 22.5 |
| No. 8 | Au | Au | 11.2 | 10.8 | 11.9 | 13.5 |
| | Sn | Sn | 12.6 | 40.5 | 13.0 | 155 |

The sample No. 5 is the connector, as shown in FIG. 3, according to the invention, and the samples No. 6, 7 and 8 are the conventional connectors 41, 42 and 43 having the bellow type contact as shown in FIGS. 4A–4C.

It will be understood from the table that although the contact resistance hardly changes at all where gold is used for the contact material of the connector and the circuit panel, where tin or tin-lead alloy is used the contact resistance of the conventional connector increases greatly, and that the connector of the invention can provide a performance nearly equal to that of the gold contact, even where tin or tin-lead alloy is used for contact material. The increase of the contact resistance depends on the direction of vibration. That is, degradation is particularly large in the direction of the Y-axis for the sample No. 6 and in X-axis for the sample No. 7. The sample No. 8 is a combination of these two samples.

The tendency of the contact resistance to increase depends on the shape of the bellows type contact, the fulcrum of the contact and the position of the operating point of the spring. For example, in case of the connector 41 in FIG. 4A, because of lack of expansion and contraction of the spring in the direction of the Y-axis, the vibration applied to the circuit panel is directly transferred as vibration at the contacting point. For the vibration in the direction of the X-axis, as the vibration supporting point A of the circuit panel is nearly at the same level as the fulcrum B of the bellows contact, even when the circuit panel vibrates, the bellows contact moves following that vibration. Therefore, vibration at the contacting point C can be reduced to the same extent, and so the contact resistance does not increase so much.

On the other hand, in the connector 42 in FIG. 4B, the bellows contact bends a little between the fulcrum B and the containing point C, as shown by a dotted line in FIG. 4B under the vibration in the direction of the Y-axis, so that the vibration at the contacting point can be reduced. However, for the vibration in the direction of the X-axis, as the vibration supporting point A of the circuit panel is on the other side of the contact point C of the bellows contact from the fulcrum B, the vibration is caused at the contact as shown by an arrow in FIG. 4, which results in an increase of the contact resistance. For the connector 43, as the bellows contact has a shape which has two bent portions $B_1$ and $B_2$ it can provide an operation corresponding to the fulcrum of the connector 41 or 42 to some extent, the vibration can be reduced and increase of the contact resistance is not so large. However, it is not perfect as shown in the above table.

In case of the connector according to the invention, as described hereinbefore, the straight portion 25 contacts the circuit panel 7, and the vibration supporting point A of the circuit panel 7 is positioned nearly at the same point as shown in FIG. 3, so that the vibration in the direction of the X-axis can be effectively reduced. For the vibration in the direction of the Y-axis, as the straight portion is held by the two fulcrums as described hereinbefore, the vibration can also be effectively reduced. Further, by providing the linear projection 28 on the straight portion 25, when the vibration is beyond the capacity of the connector to absorb as described above, sliding wear is not concentrated at one point and the linear contact is maintained. Although surface contact is also effective for dispersing the wear, it can not provide a complete contact when there is wear powder produced at the surface contact owing to repeated inserting and removing of the circuit panel. For the linear contact, such wear powder can be removed therefrom and so the stability can be increased. Moreover, the linear contact is also effective to improve the current capacity which is low for a tin or tin-lead alloy contact.

As described hereinbefore, in the connector of the invention using the base metal, tin or tin-lead alloy, for the contact, decrease of the contact performance is compensated for by increasing the mechanical contact force.

Usually, the connector has flanges at both ends thereof, and the connector is firmly mounted on a printed circuit board by screws through the flanges. Therefore, there is caused another problem that due to an increase of force needed for inserting the circuit panel into the connector or for removing it from the connector, there is caused deformation and sometimes cracking of the printed circuit board on which the connector is mounted.

In order to prevent such deformation and cracking, according to the invention, the holder of the connector is provided with three leg portions and the connector is mounted on the printed circuit board without using the flanges. An embodiment of such a connector is shown in FIGS. 5 to 9.

Figure 5A:
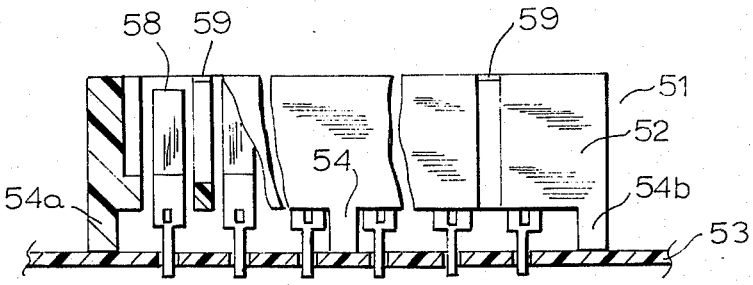
FIGS. 5A and 5B are a side view, partially broken away, of a connector and a bottom plan view thereof.
Figure 5B:
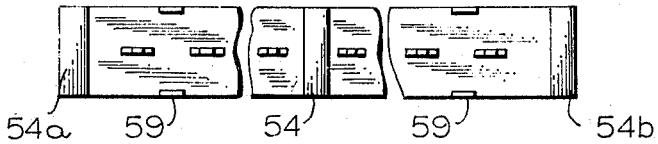
Figure 8:
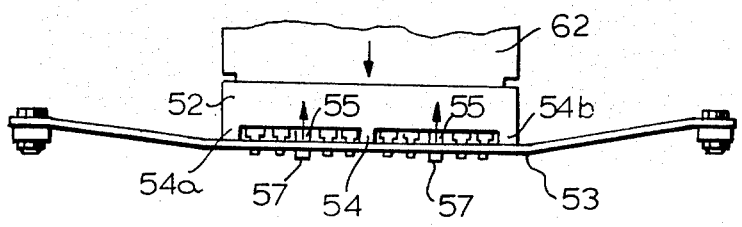
FIGS. 8 and 9 show a connector of FIG. 7 mounted on a printed circuit board, and the insertion of a circuit panel into the connector and the removal therefrom, respectively.
Figure 9:
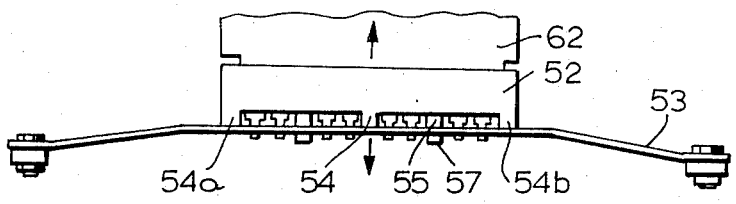

As shown in FIGS. 5A and 5B, the holder 52 of the connector 51 of the invention has leg portion 54 at the center of the bottom and two leg portions 54*a* and 54*b* at the two ends of the bottom instead of the flanges of the conventional connector. These leg portions extend transversely to the longitudinal direction of the holder and have the same height as each other. Further, the connector has two fixing legs 55 nearly at the midpoint between the leg portions 54 and 54*a* and between leg portions 54 and 54*b*, as shown in FIGS. 8 and 9. Each fixing leg 55 is made of an elastic material and has fixing means 57 at the lower end thereof which is to be fixed to the printed circuit board 53 through the fixing hole 56 thereof so as to mount the connector 51 on the board 53 instead of the conventional flange and screw.

Figure 6:
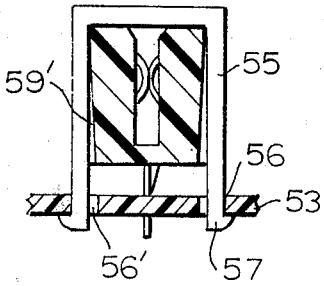
FIGS. 6 and 7 are sectional views of the connector of FIG. 5, showing the shape of fixing leg of an axial type and a rectangular type, respectively.
Figure 7:
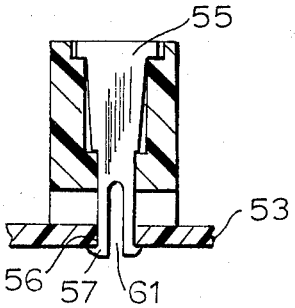

There are two types of fixing leg 55, a rectangular type and an axial type, as shown in FIGS. 6 and 7, respectively. The rectangular type fixing leg of FIG. 6 straddles the holder 52 in fixing grooves 59 of which there are a pair in both of the outer side walls of the holder 52 at a position of the partition walls for separating the adjacent contacts. In order to attach the fixing means 57 to the printed circut board 53, the fixing groove 57 has a tapered portion 59', and the fixing holes 56 of the printed circuit board 53 each have an edge 56' aligned with the bottom of the tapered portion 59' of the grooves 59, as shown in Fig. 6. Upon mounting the connector 51 on the board 53, the fixing leg 55 is inserted through the board 53 while being urged into the tapered portion 59' so that the fixing means 57 can pass through holes 56, and then the fixing means 57 are engaged under the board by springing outwardly due to their elasticity.

In case of the axial type fixing leg, there is provided a cut out portion 61 in the lower portion thereof so as to have two leg portions, as shown in FIG. 7 each of which has a fixing means thereon. Upon mounting the connector, the leg portions of fixing leg 55 are inserted in the board 53 through the hole 56, the leg portions being urged together into the cut out portion 61, and then the fixing means 57 are engaged under the board by springing outwardly due to their elasticity. In this case, the axial type fixing leg 55 is inserted through one of the cavities provided in the holder for housing the contact means, or through a fixing groove which is formed at a portion of the inner side of the partition wall 17 for separating the adjacent contacts.

When the connector is mounted on the printed circuit board by means of the elastic fixing legs, the three leg portion 54, 54*a*, 54*b* are in contact with the board. Now, on inserting the circuit panel 62 into the connector as shown in FIG. 8, although there is a force for deforming the board 53 downwards from the leg portions 54, 54*a*, 54*b*, there is also generated a reverse force upwards at the fixing legs 55 provided between these leg portions, as the fixing legs are fixed to the board by the fixing means 57. Therefore, the deformation of the board between the end leg portions 54*a* and 54*b*.

On the other hand, when removing the circuit panel 62 from the connector, there is caused a force for deforming the board upwards at the fixing leg fixed to the board. However, as the leg portions 54, 54*a*, 54*b* contact the board, there is also generated a force in the reverse direction at the leg portions, and so the deformation of the board can be prevented.

There are further advantages for the connector of the invention. That is, because the mounting flanges are omitted, the connector is smaller in overall size, and so the usable area of the printed circuit board is increased. Moreover, during mounting the connector on the board, the troublesome process of fixing the connector by screws is avoided.

There is provided another means, according to the invention, for preventing cracking of the printed circuit board due to an increase in the contact force of the connector using the tin or tin-lead alloy contact. Usually, the connector has flanges at both ends of the holder and a projecting portion for preventing erroneous mounting of the connector of one-face type on the printed circuit board. Therefore, in the printed circuit board, there are provided holes for pins of the connector (terminals of the contacts of the connector), for the screws for securing the flanges and for the projecting portion. Usually, the holes for the pins of the connector are arranged in a line. Therefore, the strength of the board along the line of holes is rather weak. Accordingly, when the circuit panel is inserted with a strong force as described hereinbefore, there is sometimes a crack caused in the board along these holes. Such a crack is made more likely because of the presence of the holes for the flanges and the projecting portion arranged near the holes for the pins of the connector.

Figure 10A:
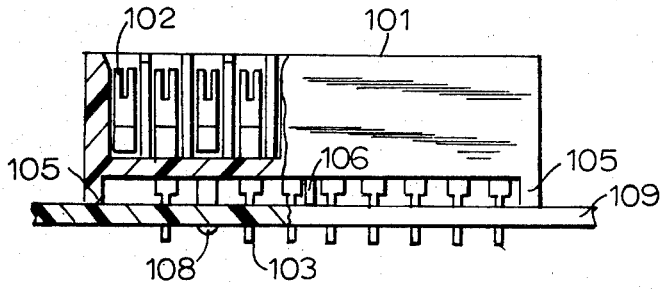
FIGS. 10A and 10B are a side view, partially broken away, of another embodiment of the invention and a bottom plan view thereof.
Figure 11:
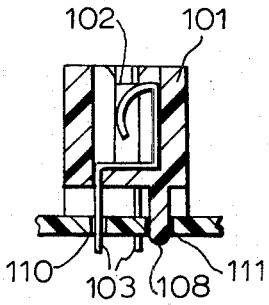
FIG. 11 is a sectional view of the connector of FIG. 10.
Figure 10B:
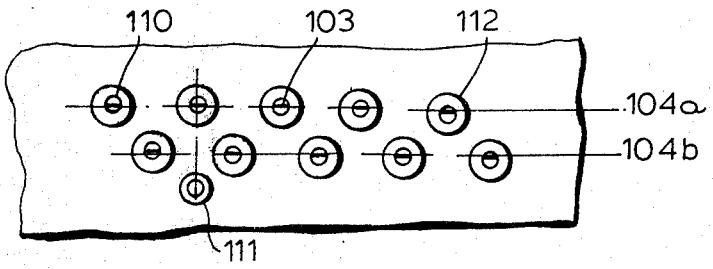

Referring to FIGS. 10A, 10B and 11, the contacts of the connector 101 according to the invention are arranged in a way such that the terminals 103 thereof for dipping in the solder are formed alternately positioned along two lines 104*a* and 104*b* on the bottom of the holder in a longitudinal direction thereof, and the holder has a projecting portion 108, which is inserted through the hole 111 in the printed circuit board 109 for preventing erroneous positioning of the connector, and which is formed between the center leg portion 106 and one of the end leg portions 105. Therefore, the holes 110 for the terminals 103 and the hold 111 for the projecting portion 108 are formed in the printed circuit board 109 in two adjacent lines and the holes 110 are staggered along the lines, as shown in FIG. 10. That is, the holes 110 are arranged at the same pitch as the pitch between the terminals 103 and with a large distance between two adjacent holes in the same line which receive every other terminal. Therefore, the strength of the board between the holes can be greatly improved compared to the conventional arrangement of one line. Further, as there is provided a wide space for applying a conductive foil 112 around each of the holes 110, the terminals 103 can be firmly fixed to the board 109 by solder dipping without using the flanges. The strength is further improved because there are no holes for the screws for the flanges. Moreover, as described above, according to the invention the hole 111 for the projecting portion 103 is at the farthest position from the center leg portion and the end leg portion where the maximum stress is applied during inserting or removal of the circuit panel. This is also effective for increasing the strength of the printed circuit board.

The mounting of the connector 101 on the printed circuit board 109 is improved by the two lines arrangement of the holes 110 in the printed circuit board, and thereby the connector is easily fixed to the board by solder dipping. In this case, this arrangement is advantageous for solder dipping because the conductive foil 112 can be applied around each of the holes 110 and yet be spaced enough for being insulated from each other. The fixing process by solder dipping is more convenient for mass production than the troublesome process of fixing the flanges of the conventional connector with screws and nuts. Moreover, because of the wide space between the adjacent holes on the board due to the two line alternative arrangement, it is possible to make a printed connection on the circuit board through the holes 110, and this is very advantageous for circuit design.

According to the invention, there is also provided means for preventing the erroneous insertion of the circuit panel into the connector by ensuring the fixing of the connector to the board. There has been described above the projecting portion for preventing erroneous mounting of the edge connector on the printed circuit board. Now, in order to prevent the erroneous insertion of the circuit panel into the connector, usually there is provided a cut-out portion 134 in the flat terminal 133 of the circuit panel 132, and a guide key is inserted into the cavity of the connector instead of the contact, corresponding to the cut-out portion 134. Therefore, when several circuit panels having different circuits are used in the same device, it is necessary to change the positions of the cut-out portion and the corresponding guide key for each panel. This is very troublesome for manufacturing the connector and becomes an obstacle to automation of assembling.

Figure 12:
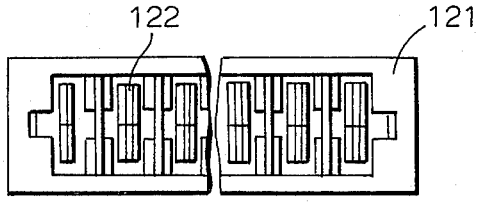
FIG. 12 is a top plan view of another embodiment of the invention.
Figure 13:
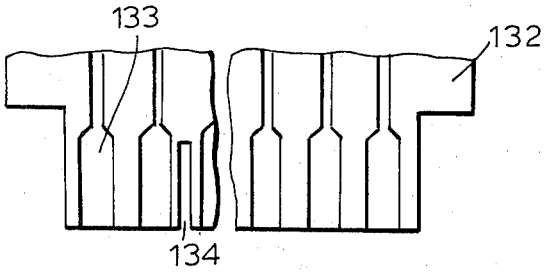
FIG. 13 shows a part of a circuit panel to be inserted into the connector of FIG. 12.
Figure 14A:
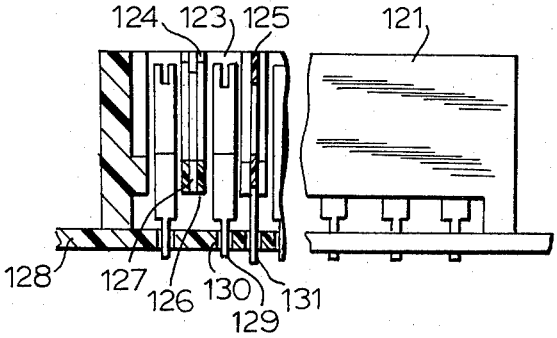
FIGS. 14A and 14B are a side view, partially broken away, of the connector of FIG. 12 and a sectional view thereof.
Figure 14B:
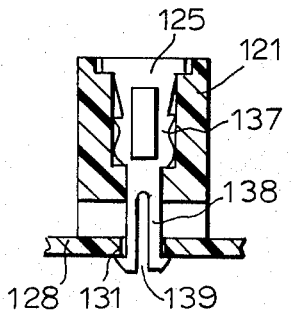

FIGS. 12–14 show the structure of the connector of the invention which is improved for overcoming such a conventional disadvantage. Referring to FIGS. 12–14, guide key groove 127 is formed in the inner side of the partition walls 124 which separate the contacts 122 in the cavities 123 of the holder 121. On the printed circuit board 128, on which the holder is mounted, there are holes 130 for the terminals 129 of the contacts 122 and a guide key hole 131 for fixing the guide key 125. The guide key hole 131 is provided at the position corresponding to the cut-out portion 134 in the flat terminal 133 of the circuit panel 132. The guide key is made of an elastic material and it has a projecting portion 137 for fixing the guide key in the guide key groove 127, leg portion 138 and a fixing portion 139, as shown in FIGS. 14A and 14B. Because of its elasticity, the guide key 125 is easily inserted into the guide key groove 127, and it is fixed to the circuit board 128. By soldering, the guide key 125 is more firmly fixed to the board 128.

With the connector as described above, mounting of the holder 121 on the board 128 is easily performed by inserting the guide key 125 into the guide key groove 127. Therefore, even when the position and the number of the guide keys are very different from connector to connector, it becomes possible to use the same kind of connectors, so that complex processes of manufacturing the connector can be simplified.

It is also possible to use the cavity 123 for housing the contact 122 as the guide key groove. Although in this case there is not provided the above advantage, there are other advantages as follows, which are also of course provided by forming the guide key groove in the partition wall. At first, because the position of the guide key is determined by the hole 131 previously prepared in the board 128, there is never erroneous insertion of the guide key. The fixing of the holder to the board is improved by the guide key, and so the conventional flanges can be omitted. This simplifies the process of mounting and securing the connector and increases the effectively usable area of the circuit board. Further, when the guide key is made of an elastic metal such as copper alloy, it is possible to ground the guide key electrically by through-hole plating so as to use it as a shield for the contact. Also, by soldering, the fixing of the guide key is made more secure.

What is claimed is:

1. An electric contact comprising a spring metal base consisting of phosphor bronze, and a layer of copper on said base having a thickness of at least two microns and a contact metal coating on said copper layer taken from the group consisting of tin and tin lead alloy.

2. An electric contact as claimed in claim 1, wherein said layer of copper is electroplated from a bath composition taken from the group consisting of cuprous cyanide and cupric sulfate.

3. A connector for a flat terminal of a circuit panel and a printed circuit board having solder dipping holes therein, said connector comprising a holder having a slot therein for receiving said flat terminal, a horizontal bottom and a plurality of cavities therein separated by partition walls for housing contact means contacted by said flat terminal, said contact means having a plurality of terminals extending out of said bottom for solder dipping through the solder dipping holes in the printed circuit board on which said connector is to be mounted, and said holder having three legs thereon, one at each end and one at the center of said bottom, respectively, said legs extending vertically to the longitudinal direction of said holder and having the same height as each other and said holder also having two recesses, one at nearly the center between said center leg portion and one end leg portion, and the other at nearly the center between said center leg portion and the other end leg portion, respectively, each recess being a pair of grooves in the opposite outer side walls of said holder at the position of the partition walls for separating adjacent contact means, said grooves being tapered to increase in depth toward said bottom, and said connector further comprising two rectangular-type fixing legs of an elastic material, each fixing leg having two depending leg portions straddling said holder, said depending leg portions having fixing means with an arrow-head shaped on the lower end thereof, said printed circuit board having thereon two pair of fixing holes for receiving only said fixed means on said printed circuit board and being at positions aligned with the bottom ends of said tapered grooves, whereby when said depending leg portions are urged into said grooves so as to fit through the fixing holes in said printed circuit board, said fixing means spring outwardly once through said fixing holes for mounting said connected to said printed circuit board.

4. A connector for a flat terminal of a circuit panel and a printed circuit panel having solder dipping holes therein, said connector comprising a holder having a slot therein for receiving said flat terminal, a horizontal bottom and contact means in said holder contacted by said terminal when said terminal is in said slot, said contact means being arranged in a one-face type connector and having a plurality of terminals extending out of said bottom of said holder for solder dipping, said terminals being in two lines on the bottom of and extending in the longitudinal direction of said holder, the terminals on one line being longitudinally offset from the terminals in the other line so as to provide a space for applying a conductive foil around each of the holes formed in the printed circuit board on which said connector is to be mounted and corresponding to said terminals of said contact means, and said holder having three legs thereon, one at each end and one at the center of said bottom, respectively, said legs extending vertically to the longitudinal direction of said holder and having the same height as each other, and said holder also having two recesses therethrough, one at nearly the center between said center leg and one end leg, and the other at nearly the center between said center leg and the other end leg, respectively, and having a projection on the bottom thereof, said printed circuit board having a hole therein for receiving said projection for preventing an erroneous mounting of said connector, said projection being at a position midway between said center leg and one of said end legs and positioned on the opposite side of one of said lines of terminals from the other line of terminals and between adjacent terminals in said one line of terminals, and said connector further comprising two fixing legs of an elastic material in said recesses, and each having fixing means on the lower end thereof, and said printed circuit board having fixing holes therein for receiving said fixing means for mounting said connector on the printed circuit board.

5. A connector comprising a holder having a longitudinal slot therethrough for receiving a flat terminal, a cavity extending into the connector from said slot, said cavity having a lower portion having a horizontal bottom with a hole therethrough and an upper portion extending laterally from the lower portion remote from said slot and a hollow depending into the holder from the upper portion of the cavity, said cavity and said hollow being separated by a wall, the top of said wall having an upper engaging portion on the side thereof facing said hollow, the opposite wall of said hollow having a lower engaging portion at the bottom thereof, the lower end of said slot constituting a stop of controlling the depth to which said flat terminal is inserted into said cavity, at least one bellows type spring metal electric contact in said cavity having a lower end portion extending through said hole in said bottom, an attached portion connected to the lower end portion and extending along the horizontal bottom and the wall of the lower portion of the cavity remote from the slot, a first bent portion in the upper part of said cavity and attached to said attached portion and having an inverted U-shape, a second bent portion in the lower portion of said cavity spaced above said attached portion and having an upwardly open U-shape and attached to and spaced laterally to the first bent portion in a direction toward said slot, a straight portion having a projection thereon along substantially the entire length thereof with a linear surface thereon parallel to said straight portion, said linear surface being covered with a layer of contact metal taken from the group consisting of tin and tin-lead alloy, said straight portion being connected to said second bent portion and extending upwardly in said cavity in the vicinity of said slot and adapted to be contacted by the flat terminal, the upper end of said straight portion being positioned at nearly the same level as said upper engaging portion of said hollow and the lower end of said straight portion being positioned at nearly the same level as bottom of said slot, a third bent portion in the upper part of said cavity above said first bent portion and attached to said straight portion and having a downwardly open U-shape, and an upper end portion attached to the third bent portion and extending downwardly into said hollow, the upper part of said upper end portion being engaged with said upper engaging portion of the wall between said hollow and said cavity, and the lower end of said upper end portion being positioned at a level lower than the center between said upper end of said straight portion and said lower end of said straight portion and engaged with said lower engaging portion of the opposite wall of said hollow, whereby the upper end of said straight portion is held by said third bent portion and the lower end of said straight portion is held by said first and second bent portions, said cavity having a dimension in the direction transverse to said straight portion such that when the flat terminal is inserted into said cavity, said straight portion is moved transversely sufficiently far to cause said first and second bent portions to be bent through more than 180°, and then said upper part of said upper end portion is moved toward the opposite wall of cavity which has said lower engaging portion thereon.

6. A connector as claimed in claim 5, wherein said bellows type contact comprises a spring metal base consisting of phosphor bronze, a layer of copper on said base having a thickness of at least two microns and a contact metal coating on said copper layer taken from the group consisting of tin and tin-lead alloy.

7. A connector as claimed in claim 6, wherein said copper layer is plated from a bath composition taken from the group consisting of cuprous cynanide and cupric sulfate.

8. A connector as claimed in claim 5 wherein said holder has three legs thereon, one at each end and one at the center of said bottom, respectively, said legs extending vertically to the longitudinal direction of said holder and having the same length as each other, and said holder having two recesses therethrough nearly at the centers between said center leg portion and one end leg portion, and between said center leg portion and the other end leg portion, respectively, and said connector further comprising two fixing legs of an elastic material in said recesses and each having fixing means on the lower end thereof for extending through fixing holes in a printed circuit board on which said connector is to be mounted for mounting said connector on the printed circuit board.

9. A connector as claimed in claim 5 in which said holder has partition walls separating said cavities and guide key recesses in said partition walls, and said connector further having a guide key of an elastic material positioned in one of said guide key recesses and adapted to extend through a guide key hole in a printed circuit board on which said connector is to be mounted and which is aligned with one of said guide key recesses for preventing an erroneous insertion of said guide key during mounting and for assisting fixation of said connector to the printed circuit board, said guide key having fixing means for fixing said guide key to said guide key recess and to said guide key hole.

10. A connector as claimed in claim 5 in which said holder has a plurality of cavities therein for housing said contact means, one of said cavities being a guide key recess and having no contact means therein, and a guide key of an elastic material positioned in said guide key recess and adapted to extend through a guide key hole in a printed circuit board on which said connector is to be mounted and which is aligned with said guide key recess for preventing mounting of a wrong connector and for assisting fixation of said connector to the printed circuit board, said guide key having fixing means for fixing said guide key to said guide key recess and to said guide key hole.

11. A connector as claimed in claim 5 wherein said contact means has a plurality of terminals extending out of the bottom of said holder for solder dipping, said terminals being in two lines on the bottom of and extending in the longitudinal direction of said holder, terminals on one line being longitudinally offset from the terminals in the other line so as to provide a space for applying a conductive foil around each of the holes formed in a printed circuit board on which said connector is to be mounted and corresponding to said terminals of said contact means, and said holder having three legs thereon, one at each end and one at the center of said bottom, respectively, said legs extending vertically to the longitudinal direction of said holder and having the same height as each other, said holder also having a projection on the bottom thereof for insertion through a hole in the printed circuit board for preventing an erroneous mounting of a connector, said projection being midway between said center leg and one of said end legs and positioned on the opposite side of one of said lines of said terminals from the other line of terminals and between adjacent terminals in said one line of terminals.

12. A connector as claimed in claim 11 in which said holder has partition walls separating said cavities and guide key recesses in said partition walls, and said connector further having a guide key of an elastic material positioned in one of said guide key recesses and adapted to extend through a guide key hole in a printed circuit board on which said connector is to be mounted and which is aligned with one of said guide key recesses for preventing an erroneous insertion of said guide key during mounting and for assisting fixation of said connector to the printed circuit board, said guide key having fixing means for fixing said guide key to said guide key recess and to said guide key hole.

* * * * *